United States Patent [19]

Vertegaal

[11] 4,070,964

[45] * Jan. 31, 1978

[54] THIN FLEXIBLE METAL SQUEEGEE BLADE FOR ROTARY SCREEN PRINTER

[75] Inventor: Jacobus Gerardus Vertegaal, Boxmeer, Netherlands

[73] Assignee: Stork Amsterdam B.V., Amstelveen, Netherlands

[ * ] Notice: The portion of the term of this patent subsequent to Dec. 21, 1993, has been disclaimed.

[21] Appl. No.: 688,613

[22] Filed: May 21, 1976

Related U.S. Application Data

[63] Continuation-in-part of Ser. No. 630,815, Nov. 11, 1975, abandoned, which is a continuation-in-part of Ser. No. 383,155, July 27, 1973, Pat. No. 3,933,093, which is a continuation-in-part of Ser. No. 811,787, April 1, 1969, abandoned.

[30] Foreign Application Priority Data

Apr. 25, 1968 Netherlands ..... 6805845

[51] Int. Cl.[2] ..... B41F 15/44

[52] U.S. Cl. ..... 101/120

[58] Field of Search ..... 101/115, 116, 119, 120, 101/157, 169; 15/256.5, 256.51, 236 R, 245

[56] References Cited

U.S. PATENT DOCUMENTS

| | | | |
|---|---|---|---|
| 1,546,834 | 7/1925 | Hanington | 101/122 X |
| 2,071,824 | 2/1937 | Engert | 101/116 |
| 2,109,336 | 2/1938 | Marsden | 101/119 |
| 2,387,390 | 10/1945 | Goodwin | 101/120 |
| 3,778,861 | 12/1973 | Goodnow | 15/256.51 |
| 3,998,158 | 12/1976 | Vertegaal | 101/120 |

FOREIGN PATENT DOCUMENTS

| | | | |
|---|---|---|---|
| 1,267,231 | 2/1968 | Germany | 101/119 |

*Primary Examiner*—Ronald E. Suter
*Attorney, Agent, or Firm*—Edmund M. Jaskiewicz

[57] ABSTRACT

A rotary screen printing machine of the type including at least one cylindrical stencil is provided with a squeegee blade for each stencil to force a printing paint or paste through apertures in the stencil onto a textile web or sheet of paper. The squeegee blade comprises a thin flexible resilient metal strip having a thickness less than 1% of the width of the portion of such strip protruding from its holder. One edge of the squeegee blade is attached to a squeegee holder and the other or trailing edge of the blade contacts the inner face of the stencil. A covering layer of a synthetic plastic may be provided on the surface of the blade directed toward the inner face of the stencil.

10 Claims, 23 Drawing Figures

18
1
23
21
20
22
24
3
19
4
5
13

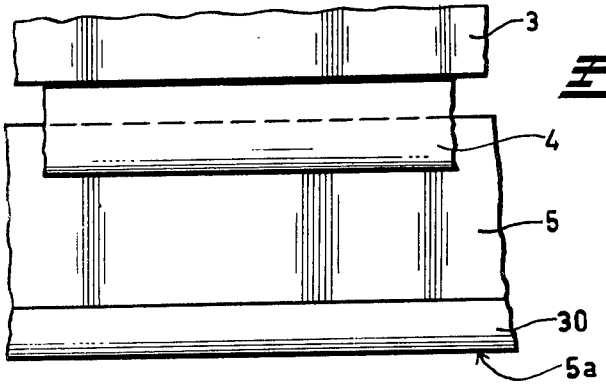
Fig: 12.
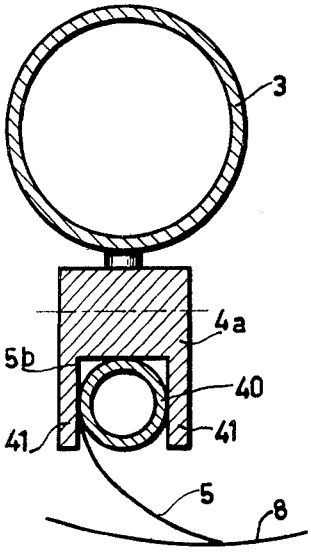
Fig: 13.
Fig: 14.
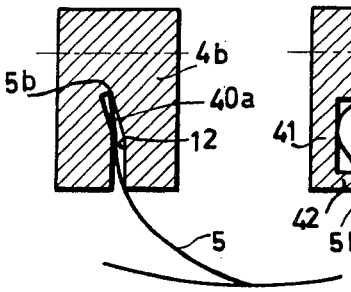
Fig: 15.
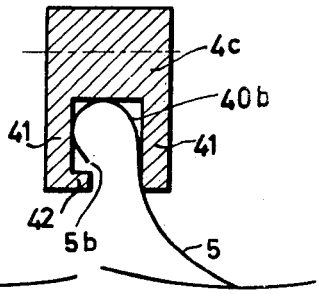
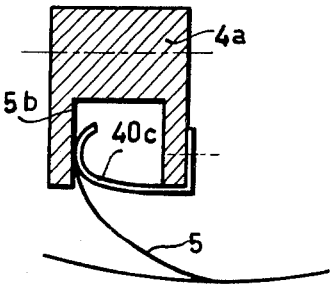
Fig: 16.

FIG: 17.
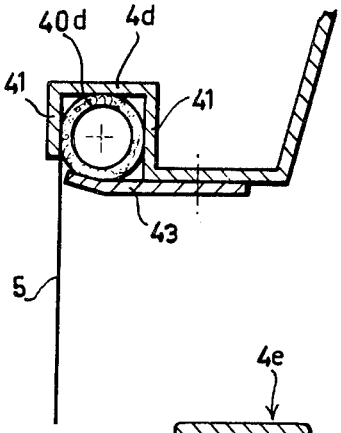
FIG: 18
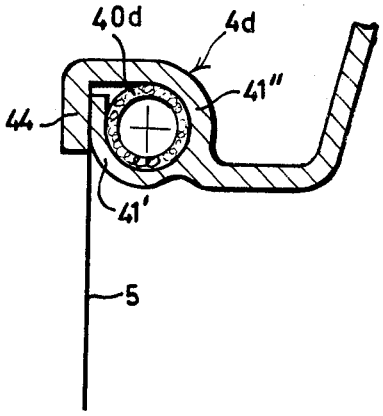
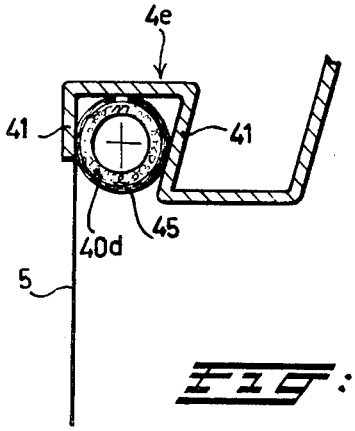
FIG: 19.

THIN FLEXIBLE METAL SQUEEGEE BLADE FOR ROTARY SCREEN PRINTER

RELATED APPLICATIONS

This application is a continuation-in-part of the copending application Ser. No. 630,815 filed Nov. 11, 1975 now abandoned, by the same-named applicant, which is a continuation-in-part of copending Ser. No. 383,155 filed on July 27, 1973 issued as U.S. Pat. No. 3,933,093 on Jan. 20, 1976, which was a continuation-in-part of Ser. No. 811,787 filed on Apr. 1, 1969, now abandoned.

The invention relates to a rotary screen printing machine provided with supporting members for the ends of one or more cylindrical stencils and with suspension members for a squeegee holder with a fitting for a thin flexible metal squeegee blade and with means for guiding the material to be printed. Different embodiments of such a machine are known in which it is always desired to construct the machine as wide as possible in order to permit the printing of a broad web or loose sheets.

However, there have been limits to the wider construction of the machine because of the deflection of the squeegee. This deflection causes a difference in the squeegee pressure of the central portion with respect to the outer portions of each cylindrical stencil. A second difficulty was experienced in that because of the great length of the squeegee, its weight increased in such a way that trouble was encountered upon pulling the squeegee device from and sliding it again into the cylindrical stencil, which is occasionally required.

The use of a metal squeegee blade marked a great advance in the rotary screen printing art. The uniformity of the printed work was improved significantly and it was now possible to vary the angle between the squeegee strip and the inner wall of the stencil over a greater range. Also a noticeable saving of weight was achieved which in practice is of particular importance when the squeegee is mounted and dismounted.

In the use of this metal squeegee blade there became apparent a vibration of the squeegee blade which appeared to be produced by a so-called marginal layer spreading between the squeegee blade and the stencil. This condition arose when the pressure in the dye paste was insufficient to lift the squeegee blade far from the stencil. The marginal layer spreading was produced when the distance between the squeegee blade and the stencil was of the same order of magnitude as the unevennesses or non-uniformity of the roughness of the stencil and the squeegee blade.

When marginal layer spreading occurred, the force of friction increased when the relative velocity between the squeegee blade and the stencil decreased. The squeegee blade in that case was slightly pulled along in the direction of the rotating stencil. The force of retention of the squeegee support increased and as a consequence of its elasticity, the squeegee blade moved back again, while the relative velocity between the squeegee blade and the stencil increased and the friction decreased. As soon as this return movement is terminated the relative velocity decreased again and the friction increased. As a consequence, a vibration was produced which caused undesired variations in the printing intensity.

The securing of the flexible strip in the fitting has been mostly effected by a plurality of clamps divided along the length of the fitting. Such a way of securing had the disadvantage that the rigidity of the fixation is not uniform throughout the length of the strip, which sometimes is perceptible in the printed product.

It is an object of the invention to provide a machine provided with a light-weight squeegee device so that a very wide machine can be assembled therewith.

It is another object of this invention to avoid such a vibration from occurring.

A further object of this invention is to simplify the securing of the squeegee blade and simultaneously to improve it.

It is an additional object of the invention to provide means to position the pressure area of the squeegee blade permanently in essentially a fixed desired zone of the stencil notwithstanding adjustments in the pressure angle of the blade. This zone may lie either exactly above the zone of contact between the stencil and the web or at a short distance before or behind that zone.

According to the present invention the squeegee blade consists of a very thin metal strip the thickness of which is less than 1% of the width of the portion of the strip which freely protrudes from the fitting and greater than 0.1% of this width.

It has appeared by experiment that this squeegee blade can easily curve or deform in the direction or rotation of the stencil, whereby a low frictional resistance with the inner side of the stencil is produced. This deformation of the squeegee is already possible at a minor pressure, so that consequently the deflection of the squeegee holder under this pressing force is limited to a minimum.

It has further appeared that the new squeegee blade allows for an ideal deformation so that an angle of pressure ranging from 90° to 3° can be adjusted, which range is beyond the limits usually obtainable with the conventional squeegees. The squeegee blade is no longer liable to chemical corrosion due to solvents in the printing mass. The steel squeegee blade is naturally stiffer in its own plane than the previously used rubber blade, so that also in this respect a lighter construction can be applied, but, nevertheless, a sufficient bending strength (rigidity) in a vertical plane is obtained.

The invention relates especially to a machine in which each squeegee holder cooperates with suspension members situated outside both ends of the stencil. A machine constructed in this way is distinguished in that the squeegee blade with its fitting is supported by the squeegee holder at two locations. By a correct selection of the suspension points, the deflection of the squeegee holder in a vertical plane will be minimal when the squeegee is downwardly loaded. The mass inertia moment of the squeegee holder may now be made considerably smaller than that of the conventional squeegee holder. Since the load owing to the squeegee pressure is smaller with the invention than in the conventional construction, the total load is considerably smaller than previously so that for that reason a lighter construction is possible and therefore a greater breadth of width of the machine can be achieved while maintaining a uniform pressure of the squeegee along the entire length of the cylindrical stencil which is generally about 1.5 meters and preferably 2.0 or even 4.0 meters.

The face of the strip or squeegee blade, which in operation in convex, is provided with a cover consisting of a material which in the non-dry condition is low in friction. This cover will decrease the so-called wet friction by al least 50%, such that the vibration symptom is efficiently eliminated. A further advantage is that because of the lower friction a higher force of pressure becomes possible whereby the uniformity with which the dye is pressed through the stencil is promoted.

According to one embodiment the cover consists of a strip of synthetic material having a width which is less than half the width of the metal strip, freely protruding from the mounting. This synthetic strip is disposed along the free edge of the metal strip.

The thin flexible squeegee strip along its edge lying in or on the fitting is provided with, or cooperates with an elastically deformable element along the entire length of the strip. The fitting may be provided with a groove, while the edge of the strip has such a shape that it only fits into the groove when it is elastically deformed. This assures that both the mounting and the loosening of the strip can be effected fast and in a simple way.

It is well known in the art that a squeegee blade for a screen printing machine is a rather long and resilient member and must be secured in the squeegee holder in such a manner that a uniform clamping force is obtained. By applying a uniform clamping force local areas or zones of increased or reduced stiffness are avoided. The presence of such zones causes differences in the intensity of the printing. It is therefore apparent that a non-uniformly clamped squeegee blade will significantly lower the quality of the product printed with such a machine.

The invention relates particularly to a squeegee device wherein the fitting consists of a U-shaped profile. According to my invention the deformable member may then consist of a rubber or plastic cord with a circular section and a diameter which is at least equal to the distance between the legs of the U-shaped profile. The securing may then be effected by means of a single tool or by hand.

Further objects and advantages of the invention will be apparent upon reference to the accompanying description when taken in conjunction with the following drawings, which are exemplary, wherein:

FIG. 12 is a side elevational view of a portion of the squeegee showing the covering layer along the free edge thereof;

FIGS. 13–16 are transverse sectional views of the squeegee device of FIG. 1 and show four embodiments for the securing of a squeegee strip from the printing machine according to FIG. 1;

FIGS. 17–19 are sectional views similar to FIGS. 13–16 and show three further embodiments of the squeegee fitting.

Figure 1:
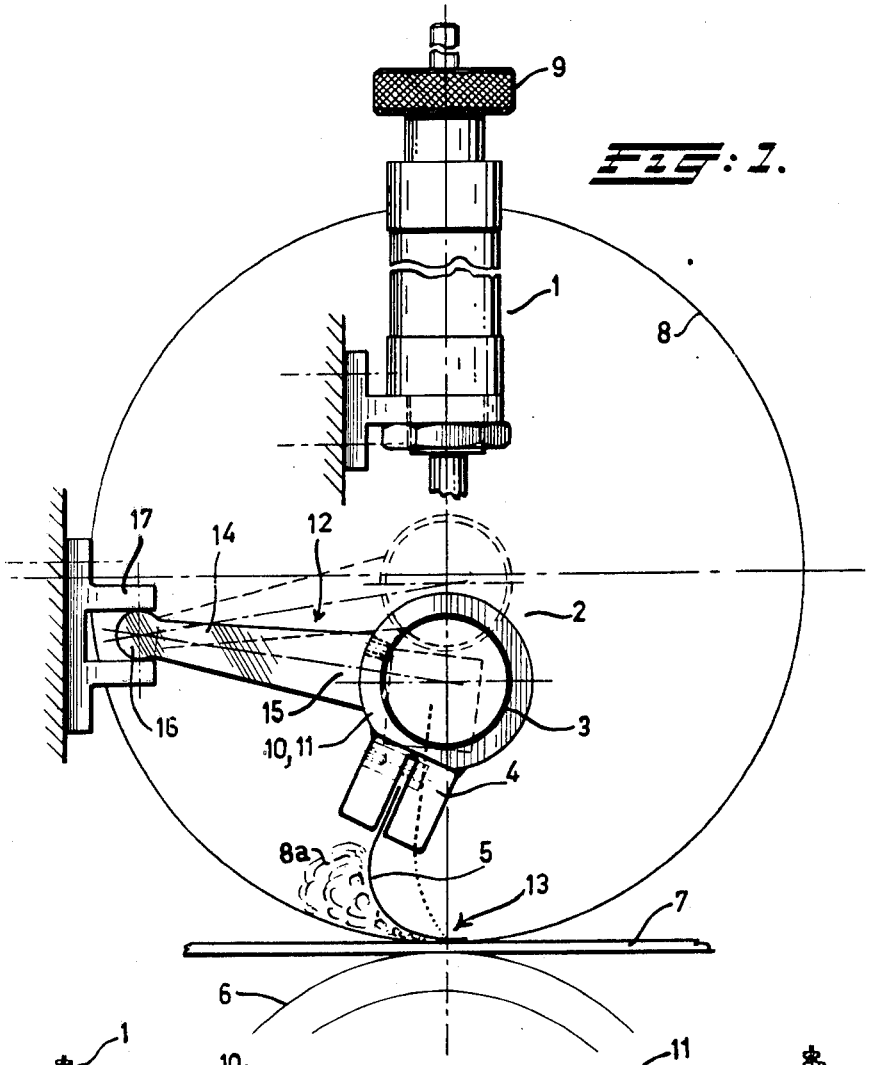
FIG. 1 shows a cross-section of a stencil provided with a squeegee device according to a first embodiment of this invention.

The rotary screen printing machine to which this invention relates is of the type as described, e.g., in the U.S. Pat. Nos. 3,291,044, 3,304,860, 3,313,232 and 3,420,167. In such a machine e.g., twelve or sixteen juxtaposed supporting members are provided for the ends of as many cylindrical stencils. For the sake of simplicity all this is not represented in the drawings.

The machine is likewise provided with suspension members 1 for the squeegee device 2 within each stencil. The latter device consists of a squeegee holder 3 provided with a fitting 4 for a flexible squeegee blade 5. The machine is further provided with means such as roller 6 for guiding the material to be printed. When this material is sufficiently rigid in itself, it may directly bear on the means 6 embodied as supporting rollers, but in the case of weak material, like e.g., textile, a supporting belt 7 can be applied in the usual way.

Figure 10:
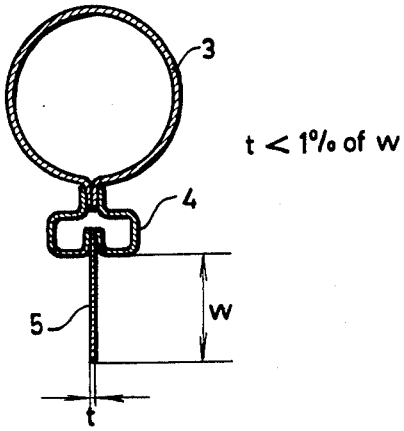
FIG. 10 is a diagrammatic elevational view of the holder and blade showing the thickness-width relationship.

In the previously known machines the squeegee blade mostly consists of rubber or other such flexible material. According to the present invention the squeegee blade 5 consists of a thin metal strip of stainless steel having resilient properties or spring steel having a surface finish the thickness ($t$) of which is less than 1% of the generally vertical width ($w$) of the portion of the strip which freely protrudes from the fitting 4, and greater than 0.1% of this width as shown in FIG. 10. The length of a squeegee blade is at least 80 inches and is generally between 80–100 inches. The thickness of the blade is 0.004 inches which is the equivalent of 0.1mm. The width of the freely protruding portion of the strip from the fitting is approximately 2 inches. The material of the blade is a spring steel which has been subjected to a heat treatment in order to improve the resiliency of the blade under a load. The force exercised upon the entire squeegee in order to bend the squeegee blade into the desired curvature is 50 kilograms or 110 lbs. If desired, it is also possible to apply a strip of synthetic material to the blade as shown in FIG. 12, provided this material has an elastic flexibility analogous to that of metal. Such a material may be Vulkolan or Teflon, depending on the type of paste or paint used.

The suspension members 1 each consist of a pneumatic cylinder (see FIG. 2) the piston of which is pivotally secured to the squeegee device by suitable bearing means, by which means the squeegee device 2 can be lifted and lowered in order to release the squeegee blade 5 from the cylindrical stencil 8 or bring it again into contact therewith. The lower position of the squeegee device 2 and as a consequence the angle at which the blade 5 exerts its printing function is adjusted by the aid of the adjusting nut 9.

Figure 2:
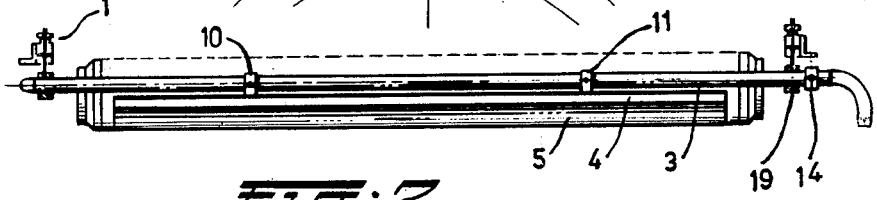
FIG. 2 shows to a considerably smaller scale a side elevation of a complete squeegee device.

As is visible in FIG. 2, each squeegee blade 5 is via its fitting 4 supported at two locations 10 and 11 by the squeegee holder 3. This holder is constructed as a tube serving as a printing paste or paint feeding conduit.

Figure 11A:
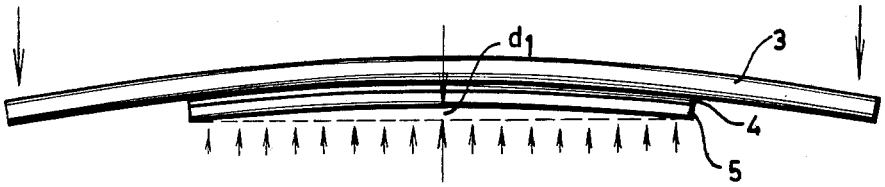
FIG. 11 shows diagrams illustrating the deflection of the blade in the prior art (A) and according to the present invention (B)
Figure 11B:
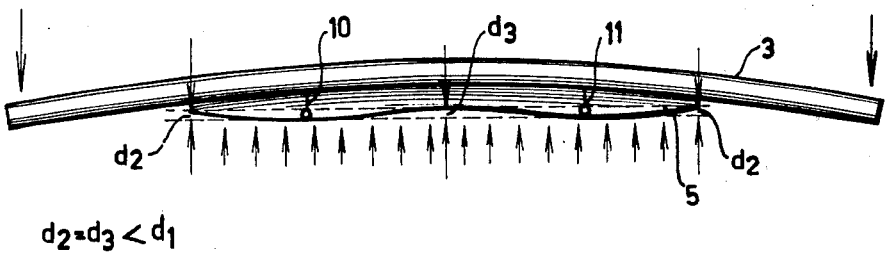

The locations 10 and 11 are so selected with respect to the ends of the holder 3 that the deflections ($d_2$) at the ends of the blade 5 are almost equal to the deflection ($d_3$) of the blade at its center as illustrated in FIG. 11B. Both of these values of deflection are considerably less than the maximum deflection ($d_1$) resulting when the blade 5 is secured along its entire length to the holder 3 as illustrated in FIG. 11A.

Means 12 are provided in each squeegee device 2 cooperating with the squeegee holder 3 in order to displace the latter in a generally horizontal direction during its height adjustment in such a manner, that the pressure area 13 of the squeegee blade 5 is always situated in a substantially fixed zone of the stencil; that is to say the zone which is in touch with the material to be printed, or a region at a short distance before or after that zone. These means 12 consist of an arm 14 outside at least one end of the stencil 8.

This arm 14 is connected at its one end 15 with the squeegee holder 3, and is pivotally supported at its other free end 16. Since in this embodiment the suspension members 1 exclusively allow a vertical displacement of the squeegee holder 3, the end 16 of the arm 14 can undergo, via the bracket 17, a limited shifting in a direction parallel to the travel of the material to be printed, that is to say, of the belt 7. This construction causes a turning of the squeegee holder 3 on lowering the squeegee device 2 and a tilting of the supporting locations 10 and 11 and consequently of the fitting 4 in such a manner that the pressure area 13 of the squeegee blade 5 remains within the correct region.

Figure 3:
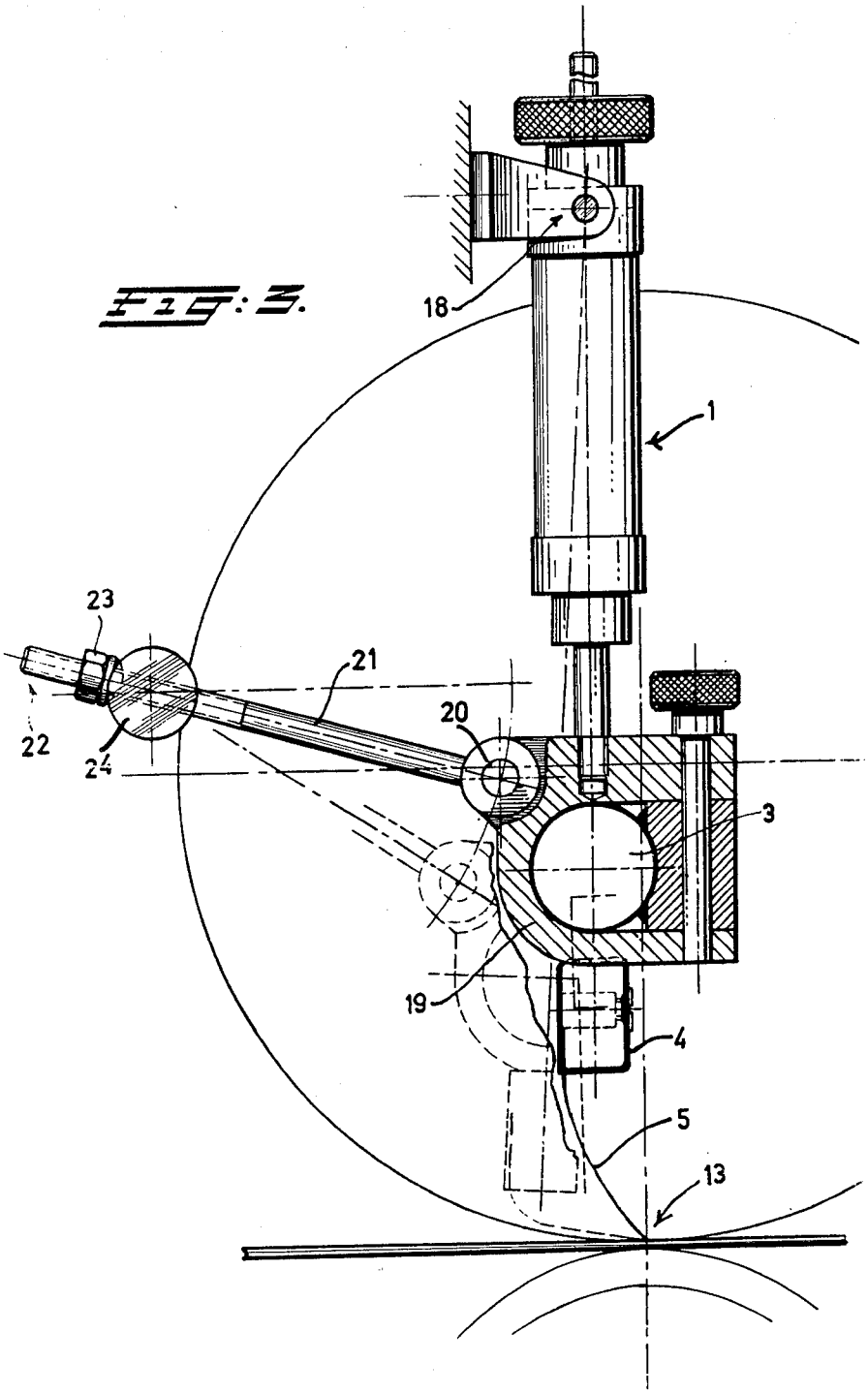
FIG. 3 is another embodiment of the squeegee device in a section corresponding to FIG. 1.

In the embodiment according to FIG. 3, the suspension members 1 are pivoted at 18 to the frame of the machine. Each suspension member 1 is secured to the squeegee holder 3 by means of a clip 19 which loosely surrounds the holder 3 and permits sliding rotational movement thereof relative to the clip 19. These clips are situated outside the ends of each stencil 8 and are each pivotally connected with one end of an arm 21 through a tenon 20. Each arm 21 has at its free end 22 a point of support 24 pivotable about a fixed axis which however is adjustable by means of a nut 23. These elements 19–24 constitute an equivalent of the means 12, as described with reference to FIG. 1.

Figure 4:
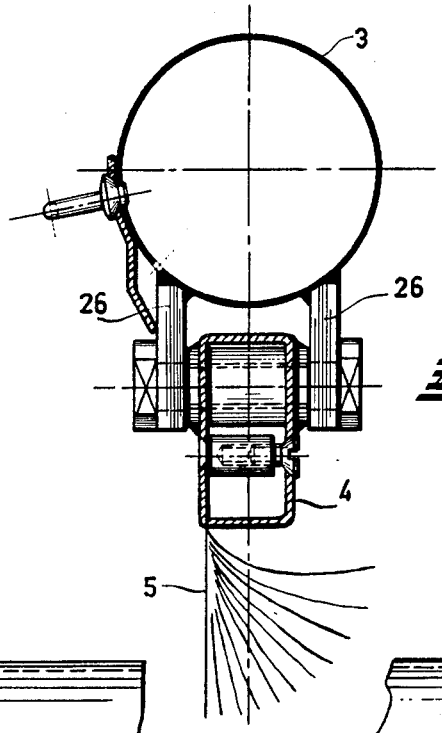
FIG. 4 shows a detail of the squeegee device according to a third embodiment.
Figure 5:
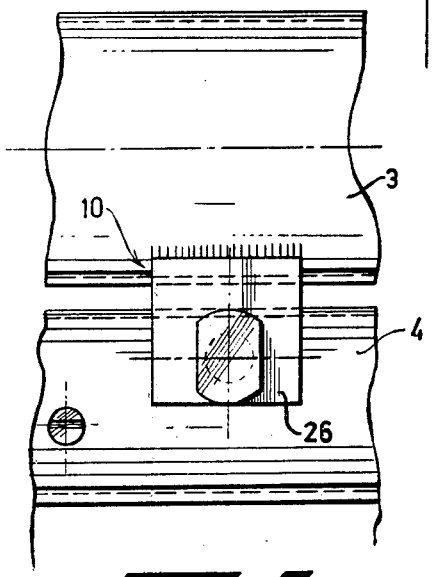
FIGS. 5 and 6 show front views of the two suspension points of the squeegee with its fitting to the holder in the embodiment according to FIG. 4.
Figure 6:
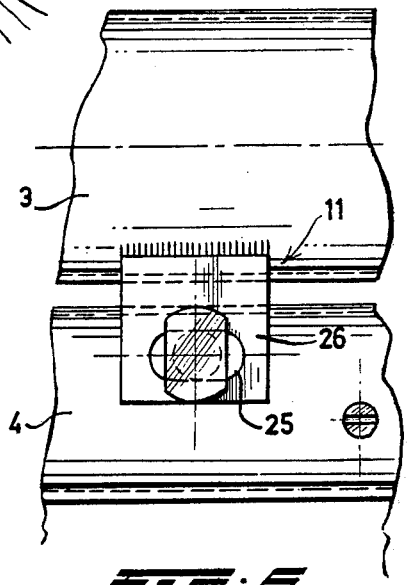

FIG. 4 shows an embodiment of one of the supporting locations 10 or 11 at which the fitting 4 of the squeegee blade 5 is supported by the squeegee holder 3. FIG. 5 shows a view of the supporting location 10 at which the fitting is fixed to the holder 3 for rotation therewith. The supporting location 11 depicted in FIG. 6 is provided with an elongated hole 25 in the connecting strips 26, so that there is a limited possibility of longitudinal movement between the fitting 4 and the holder 3 to allow for differences in the bowed lengths of these under vertical pressure.

This limited possibility of relative displacement is of importance because the vertical deflection of the squeegee holder or paint feeding conduit 3 is generally different from the corresponding vertical deformation of the combination fitting 4 with squeegee blade 5 resulting in different lengths of these when bowed by application of vertical pressure against the stencil 8.

Figure 7:
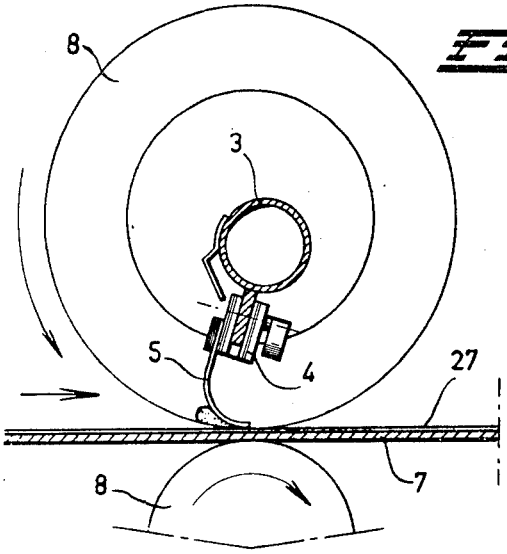
FIGS. 7–9 and 7A–9A show the influence of the location of the pressure area of the squeegee.
Figure 7A:
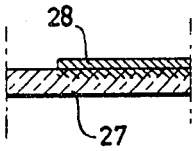
Figure 8:
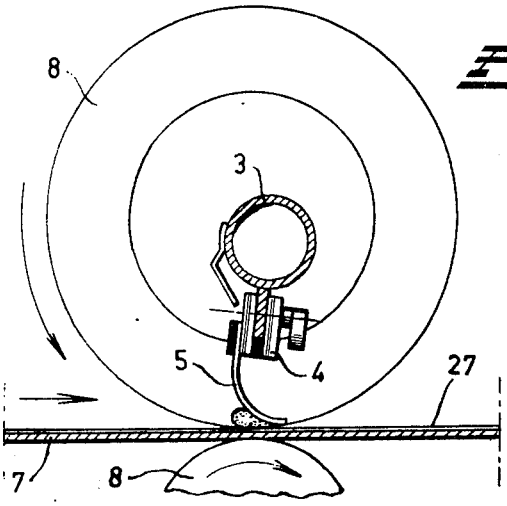
Figure 8A:
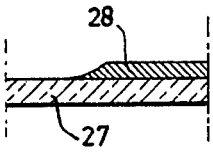
Figure 9:
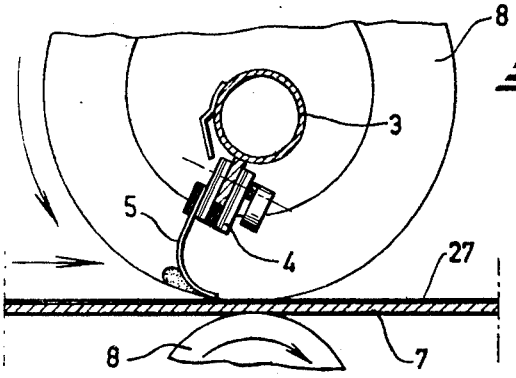
Figure 9A:
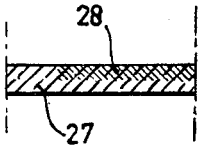

FIG. 7 shows the situation in conformity with the FIGS. 1 and 3, a paint imprint 28 being formed on the web 27 to be printed, the imprint being partially on and in the web (see FIG. 7A). When the layer of paint should be entirely on the web and the penetration of the paint into the web should be reduced to a minimum, the pressure area of the squeegee 5 should be slightly shifted to behind or beyond the point according to FIG. 7. This situation is attained by unscrewing slightly the nut 23 from the construction according to FIG. 3. Should it be desired for the paint to be entirely pressed into the web, then the arm 21 of FIG. 3 is slightly shortened so that the conditions according to FIGS. 9 and 9A occur.

As shown in FIG. 12, the squeegee blade 5 is provided with a cover 30 of a material which in the non-dry condition is low in friction. This cover 30 is on the face of the strip, which in operation is convex. In FIG. 1 this means that the cover 30 is in the vicinity of the lower end of the strip 5 on the side which is directed toward the inner wall of the stencil 8, which side is in contact with the printing paste or dye 8*a*.

The cover 30 consists of a strip of synthetic material with a width which is less than the half of the width of the metal strip 5, protruding from the mounting 4. This strip is disposed along the free edge 5*a* of the strip 5. The strip can further consist of a polyolefin which has the property that in a wet environment the friction is about 50% of that of the steel of which the strip is made.

The cover 30 is advantageous because the force of friction exerted on the squeegee 2 by the rotating stencil 8 decreases considerably. As a consequence the vibration of the squeegee as described above which occasionally is produced will be limited to a minimum or even entirely eliminated. Due to the elimination of the vibration the variations in printing produced thereby are also avoided. Furthermore, a greater pressure force of the squeegee can be applied (due to the considerably reduced friction) so that the dye is passed more efficiently and more uniformly through the stencil. It has also been found that due to the reduced braking effect of the squeegee on the stencil the consecutive stencils operate in such a way that there is a lesser risk of breaking the repeat design.

An elastically deformable part 40 is provided along the edge 5*b* of the strip 5 secured in the fitting 4*a*. This part 40 may constitute a separate member (see FIGS. 13 and 16) but may also consist of an area 40*a*, deformed or not, of the strip 5 along the edge 5*b* (see FIGS. 14 and 15). According to FIG. 13 the deformable part consists of a rubber or plastic cord 40 with a circular cross-section and a diameter which is at least equal to the distance between the legs 41 of the fitting of substantially U-section. In the embodiment according to FIG. 14 the fitting 4*b* is provided with a groove 42 while the part 40*a* along the edge 5*b* of the strip 5 has such a shape that this edge fits into this groove only after elastic deformation.

The modification according to FIG. 15 is distinguished in that the part 40*b* has a beaded shape which can snappingly engage the space between the legs 41 of the fitting 4*c* whereby an inwardly directed lip 42 prevents the part 40*b* from leaving that space unintentionally. In the embodiment according to FIG. 16 the elastically deformable part consists of a resilient lip 40*c* by which the strip 5 is clamped in the fitting 4*a*.

FIGS. 17–19 show modifications of the embodiment according to FIG. 13, in which the elastically deformable part consists of a hose 40*d* which can be filled with compressed air, to fix in this way the strip 5 in its position. According to FIG. 17 a cover plate 43 closes the fitting 4*d* for the greater part. In the embodiment according to FIG. 18 the leg 41 of the fitting is flexible. The strip 5 of the squeegee is here clamped between this leg 41′ and an elongated and curved part 44 of the other leg 41″.

In FIG. 19 a resilient (e.g., split) plastic tube 45 is disposed around the hose 40*d*. The legs 41 of the fitting 4*e* converge so that the fitting has a dove-tail-like cross-section.

The cord 40*d* may be solid or hollow and in the latter case it may have one end closed and the other end connected to a source of fluid pressure so that the cord is expanded by fluid pressure in order to fix the squeegee strip 5 firmly. It is also conceivable to make the hollow cord (the hose) first thinner by using a vacuum whereupon, after the squeegee strip has been mounted, the vacuum is broken, so that the hose expands again to thereby fix the squeegee strip. It is also possible to deform the fitting 4 itself by means of the inflatable hose for fixing the strip.

It should be noted that this invention is described with reference to the squeegee device 2. It is however, also possible to use the fixing structure of the strip 5 in a paint feeding member provided with two opposite strips 5, wherein-between a slit is situated lying against the inner surface of the stencil 8. An example is described in my co-pending Patent application Ser. No. 443,317 filed on Feb. 19, 1974.

The present invention thus maintains a thin squeegee strip in the fitting in such a manner that the strip can be readily removed but at the same time is retained uniformly in position. When the squeegee blade is a thin metal strip which is used to produce fine printing work it is mandatory that the blade be retained with a uniform force along its entire length. Should the mounting force be localized such as would be obtained with a series of clamps, these localized areas of the strip would then give non-uniform printing results.

The use of local clamping strips would certainly not produce the result of this invention since the stiffness or resiliency of the squeegee blade would not be uniform along its entire working length.

The present invention has provided a single elastically deformable element within the groove in which the squeegee blade is inserted so that this element directly contacts the entire length of the blade. At the same time, the leastically deformable element permits the ready removal of the squeegee blade for maintenance or replacement purposes.

It is to be noted that the present invention deals with a squeegee strip or blade which is known in the art and is extremely thin and flexible. Thus, structures to retain rigid types of blades in a fitting are not at all pertinent to the present invention.

The advantages of the machine according to the invention can be summarized as follows:

the occurring forces and the weight of the squeegee device can be reduced in such a considerable manner, that the width of the machine can be increased without the risk of a harmful vertical deflection of the squeegee that is to say without light and dark coloured zones being produced on printing;

the friction between the steel squeegee and the nickel stencil is less than with a rubber squeegee, which is favorable from the viewpoint of wear and tear and consequently for the life of the squeegee device and the stencil;

the metal squeegee allows a particularly great variation in pressure angle ranging between 90° and 3°;

using a metal squeegee requires a much smaller force for applying the same amount of paint than in case of a conventional squeegee, which contributes to obtaining a light weight construction;

the two-point suspension of the squeegee results in smaller maxima of the deflection of the squeegee than with the conventional securing of the squeegee along its entire length;

no chemical corrosion is produced in the case of a metal squeegee because stainless steel can be utilized, but also spring steel which has been subjected to a special surface treatment such as a surface coating to reduce chemical corrosion as a result of being in contact with printing inks and pastes.

It will be understood that this invention is susceptible to modification in order to adapt it to different usages and conditions, and accordingly, it is desired to comprehend such modifications within this invention as may fall within the scope of the appended claims.

What is claimed is:

1. A squeegee blade for a rotary printing machine and comprising a thin flexible resilient metal strip having an edge thereof attached to a squeegee holder within a cylindrical screen stencil of the rotary printing machine such that a portion thereof freely protrudes from the holder, said blade having a transverse trailing edge for contacting the inner surface of a stencil in the region of the zone of the stencil contacting the material to be printed, said blade having a thickness of less than 1.0% of the width of its freely protruding portion, said blade being flexible through an angle ranging from 90° to 3° with respect to the inner surface of the stencil to vary selectively the quantity of printing fluid pressed through the stencil by the blade trailing edge.

2. A squeegee blade as claimed in claim 1 wherein said blade is made of stainless steel.

3. A squeegee blade as claimed in claim 1 wherein said blade has a length up to about four meters.

4. A squeegee blade as claimed in claim 1 wherein the protruding portion of said strip is deflected when in operation such that a face of said strip directed toward an inner wall of the stencil and in contact with the printing fluid is convex, and a covering layer consisting of a synthetic material having a low friction when in the non-dry condition along the free edge of said convex face of said strip to reduce friction exerted on the squeegee by the rotating stencil.

5. A squeegee blade as claimed in claim 4 wherein the covering layer consists of a strip of synthetic material having a width transverse to the strip free edge which is less than half the width of the freely protruding portion of the metal strip.

6. A squeegee blade as claimed in claim 5 wherein the synthetic strip protrudes freely beyond the free edge of the metal strip over a distance which is at least equal to the thickness of the synthetic strip.

7. A squeegee blade as claimed in claim 1 wherein the metal strip on one face along the free edge of the strip is provided with a cover made of a material which in a wet environment has a low coefficient of friction.

8. A squeegee blade as claimed in claim 1 and an elastically deformable element directly contacting along the length of said strip edge to secure said strip in a dismountable manner to the holder.

9. A squeegee blade as claimed in claim 8 wherein said deformable element comprises a rubber cord having a circular cross-section.

10. A squeegee blade as claimed in claim 8 wherein said deformable element comprises a tube of elastic material, said tube at one end being closed and at its other end being connected to a conduit for a pressure fluid.

* * * * *